United States Patent [19]

Citrin

[11] 4,369,665

[45] Jan. 25, 1983

[54] MANUALLY HOLDABLE AUTOMATIC PIPETTE

[75] Inventor: Paul S. Citrin, Danbury, Conn.

[73] Assignee: Indicon Inc., Brookfield Center, Conn.

[21] Appl. No.: 33,044

[22] Filed: Apr. 25, 1979

Related U.S. Application Data

[63] Continuation of Ser. No. 868,687, Jan. 11, 1978, abandoned.

[51] Int. Cl.[3] ..... B01L 3/02

[52] U.S. Cl. ..... 73/864.18

[58] Field of Search ..... 73/425.6

[56] References Cited

U.S. PATENT DOCUMENTS

| | | | |
|---|---|---|---|
| 2,925,198 | 2/1960 | Healey | 222/76 |
| 3,175,734 | 3/1965 | Heiss | 73/425.6 |
| 3,395,704 | 8/1968 | Frey et al. | 128/DIG. 1 |
| 3,719,087 | 3/1973 | Thiers | 73/425.6 |
| 3,827,305 | 8/1974 | Gilson et al. | 73/425.6 |
| 3,853,012 | 12/1974 | Scordato | 73/425.6 |
| 3,915,651 | 10/1975 | Nishi | 73/425.6 |
| 3,918,308 | 11/1975 | Reed | 73/425.6 |

*Primary Examiner*—S. Clement Swisher

*Attorney, Agent, or Firm*—St. Onge, Steward, Johnston & Reens

[57] ABSTRACT

An automatic pipette is described which can be manually held yet provides a highly accurate instrument capable of precise handling of very small liquid samples. A main housing is provided sized to be conveniently held in the hand of an operator. The housing encloses a displacement mechanism of a size selected to provide a highly accurate handling of small liquid samples as well as a motor drive, control circuit and a power source. The control circuit provides a precise control over rate of intake and dispense and is selected to reduce power demand while maintaining safety features to simplify operator manual control. A technique is described to enhance engagement between the pipette and a replaceable tip for low air leakage and attendant enhanced take-up accuracy, as well as provide an integral method for gentle tip removal after contamination. A dilution pipette is described to provide a highly accurate dilution of small liquid samples.

28 Claims, 12 Drawing Figures

Fig. 5.
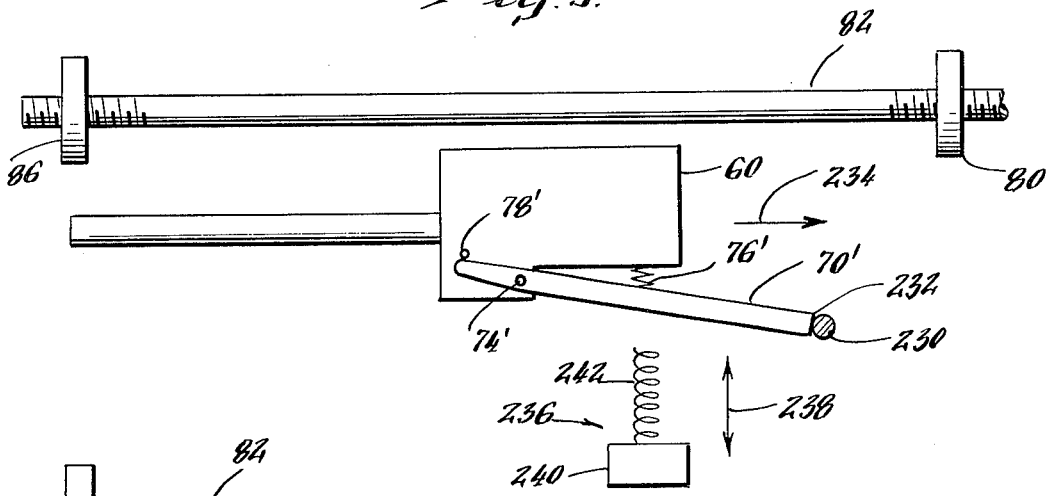
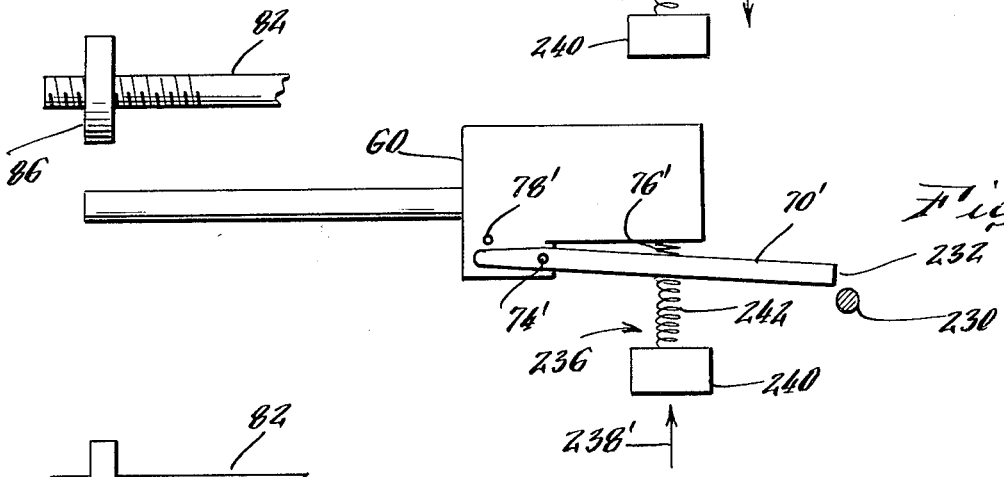
Fig. 6.
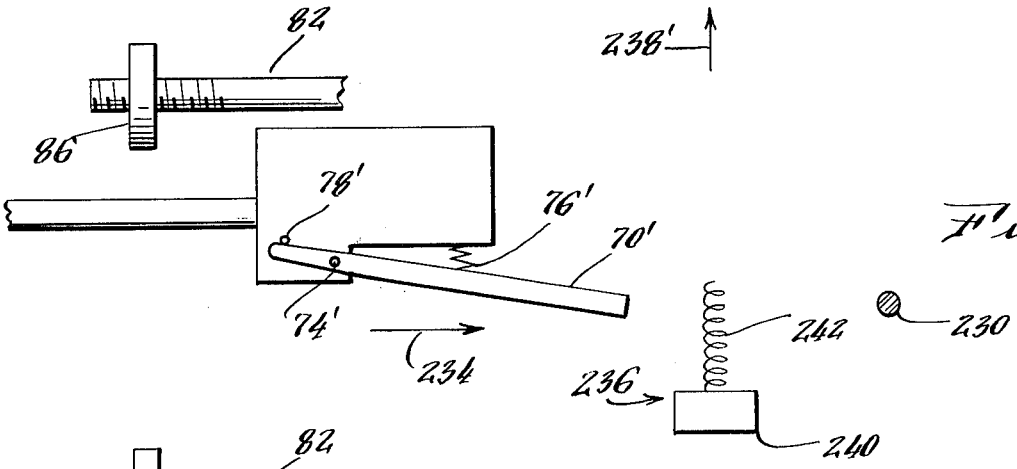
Fig. 7.
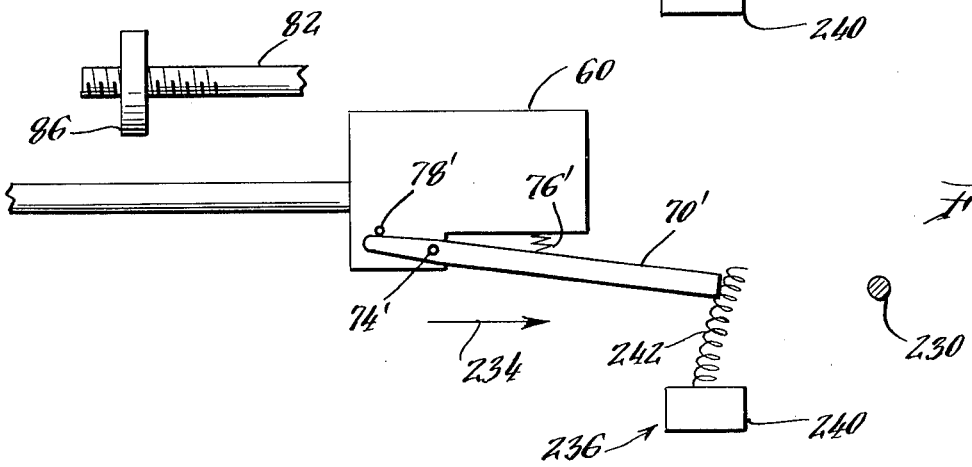
Fig. 8.

MANUALLY HOLDABLE AUTOMATIC PIPETTE

This is a continuation of application Ser. No. 868,687, filed Jan. 11, 1978 now abandoned.

FIELD OF THE INVENTION

This invention relates to pipettes generally and more specifically to hand holdable pipettes which take up and discharge a predetermined amount of liquid.

BACKGROUND OF THE INVENTION

Manual pipettes for taking up and discharging precise quantities of liquid are well known in the art. A typical manual pipette is described in U.S. Pat. No. 3,766,784 to Walker. Such pipette includes a manually moved knob which is connected to a piston operating in a cylinder of a pipette barrel. To actuate the pipette the operator moves the knob a distance equal to the stroke of the piston to seat it at an intake position. Release of the knob causes drawing in of liquid. The liquid is discharged by again moving the knob past the intake position until the piston seats on a discharge stop. Walker further shows and describes the well known use of a disposable tip removably mounted to the pipette to receive the liquid and avoid both hand and pipette wetting by the liquid being processed.

The liquid quantities involved in dispensing with a pipette may vary, but often are quite small. Typical quantities may be of the order of 1 to 1,000 microliters in either fixed increments or variable ranges of 1–20, 20–100, 100–250, 250–1,000, 1,000–5,000 micro liters are common. Variations of any selected value for these liquid qualities may affect the tests for which the pipette is used and care must be taken to assure uniformity in the take-up and dispensation of liquids with a pipette.

With prior art manually actuated pipettes, undesirable variations are introduced in the liquid samples due to a number of causes of which the most significant are attributable to operator handling. These errors arise by virtue of the fact that mechanical action is supplied by the operator's hand as the source of energy to pick up and dispense small quantities of liquids. Different volumes are quite frequently dispensed by different operators using identical fixed pipettes or identical settings on variable pipettes. This error is of concern to the analyst who depends upon the accuracy of the results to indicate what medication need be administered.

For instance, in the depression of the pipette control knob, the operator's thumb is employed. This places a practical limit on the length of the stroke of the piston to that which is comfortable and suitable for the hands of most operators. For enhanced accuracy, however, particularly involving small volumes, it is preferred that the piston stroke be long with a small cylinder bore cross-section. Such longer stroke, however, cannot be conveniently accommodated by the stroke capacity of the operator's thumb without quickly causing operator fatigue.

Some operators develop, through practice, an impressive speed and repeatability in the use of a manual pipette. As a result, a particular operator may handle liquid samples in an accurate manner. Fatigue, however, frequently is likely to show up as a change in the accuracy or repeatability in the use of the pipette. For example, over an extended period of use, such as may be involved in a medical diagnostic test procedure, the depression of the control knob against a spring may not consistently result in precisely the same fill or take-up stroke.

In many pipettes depression movement of the piston is possible beyond an intake position stop to accommodate a longer discharge stroke and achieve a blow out feature of the previously taken up sample. A slight overshoot of the piston during the intake operation is likely to cause an accuracy error. Also, since the discharge stroke is made against the spring pressure, the discharge of the liquid sample may be but partially completed causing an error in the amount of liquid being dispensed.

The speed of the strokes also affects the accuracy of the manual pipette. Although the intake stroke occurs with the aid of a spring bias, the operator controls the speed by resisting the spring force—thus reducing the speed of intake as a function of operator "feel." An experienced operator may be capable of providing consistent speeds of intake and discharge strokes, but usually for limited periods below operator fatigue levels. Generally, regardless of the operator technique or speed, the speed and thus accuracy in the case of a conventional pipette, tends to vary. Hence, reliability of repeated or rerun procedures is compromised.

Although these operator errors may appear small, the errors are frequently considered too great for reliable comparison of diagnostic tests performed at different laboratories by different manual pipette operators. This frequently leads to unnecessary repeats of tests as well as a large number of tests to establish statistically reliable results. If greater consistency in the use of manual pipettes could be achieved, greater reliance upon laboratory test results can be placed.

Automatically operated pipettes of various types have been described in the prior art. In the U.S. Pat. No. 3,915,651 to Nishi, a digitally controlled pipette is described. The device dispenses small quantities of a liquid from a reservoir with a stepping motor which rotates a screw feed connected to a piston. Sample volumes may be delivered with an accuracy of the order of 0.2% for a 100 micro liter sample to 0.08% for an 800 micro liter sample. The Nishi pipette employs a stand mounted pipette whose operation is regulated by a separate controller. Such construction cannot be considered suitable to a portable hand-holdable application in which high dexterity is needed to perform rapid motions between wells on a tray used in a medical diagnostic tests or between more distant test stations. The construction of the Nishi pipette, furthermore, is not suitable to reach into test tubes.

The U.S. Pat. No. 3,719,087 to Thiers describes a manually controlled automatic pipette attached to a vacuum and pressure source by flexible tubes to respectively provide intake and discharge of liquid. The inaccuracy introduced in the pipetting of very small quantities with such device tends to be excessive and the device is not conveniently portable by virtue of a reliance upon flexible connecting tubes for actuation. Repeatability of this device is an eyeball affair. The unit is also location limited due to the use of air-vacuum lines.

SUMMARY OF THE INVENTION

With an automatically actuated pipette in accordace with the invention, a hand holdable pipette having an integrally mounted cylinder and piston with a motor drive and control mechanism yet capable of a highly accurate take-up and discharge of liquid samples over a very side range of sizes is provided.

With a pipette in accordance with the invention, inaccuracies from operator actuation are effectively reduced while maintaining high manual dexterity with precision performance.

As described with reference to a preferred form for a pipette in accordance with the invention, a pipette housing is provided with a size shaped to be conveniently held by hand. The housing encloses a cylinder and piston, a piston motor drive with reduction gears, control circuits and power source; yet is sufficiently small to be conveniently held and operated with high dexterity. The operation of the pipette is fully automatic after a simple manual actuation which only initiates the operation and cannot affect accuracy of the pipette. A piston drive produces a smooth intake stroke of the piston from a precisely defined intake position to a fill position representative of the intake of a precisely predetermined amount of liquid. A sensor is employed to detect arrival of the piston at its fill position and deactivate the piston drive. A subsequent manual actuation initiates an automatic discharge stroke of the piston to eject the liquid sample.

In one form of a pipette in accordance with the invention, the sample ejection is followed by a blow-off operation to assure complete discharge. The blow-off is obtained by advancing the piston past the start position of the intake stroke. After sample ejection and removal of the pipette tip from the fluid, the pipette is cocked for a subsequent actuation by returning the piston to its precisely defined intake starting position.

With an automatic pipette in accordance with the invention, high operating accuracies are achieved. The piston stroke is made substantially greater than what can be accommodated by a thumb actuated stroke. As a result, the cylinder bore can have a small cross-sectional area for improved accuracy at small sample volumes.

The consistency of an automatically driven piston in a hand holdable pipette enhances the repeatability of the instrument's performance independent of the operator. Stroke speed variations are reduced and consistency in the quantity of a liquid sample taken up and discharged is obtained. With an automatic hand holdable pipette in accordance with the invention motor speed can be precisely regulated to achieve a high degree of consistency in the pipette operation. The motor speed can be selected separately for intake and discharge strokes.

With an automatic hand holdable pipette in accordance with the invention, the intake of a liquid sample is accurately controlled by defining the length of the intake stroke in a precise manner. As described with reference to a preferred embodiment, a mechanical gate element is employed against which the piston is seated to precisely define its intake start position. At the start of an intake stroke the gate element is removed and the piston driven to a full position as determined by a stop placed in the path of the piston.

Sensors are employed to detect the arrival of the piston at the gate element and the full position and effectively disconnect the drive from the power source such as a battery. When the operator requires discharge of the liquid sample stored in the pipette, the drive is actuated in the correct direction and the piston is driven to a discharge position to eject the previously stored liquid sample.

With an automatic hand holdable pipette in accordance with the invention, a self-contained device is provided capable of long term operation on battery stored power. Circuitry and actuating elements are employed in a manner to conserve battery power while preserving fully automatic operation in the take-up and discharge of liquid samples.

It is, therefore, an object of the invention to provide a pipette which is hand holdable, yet can be automatically operated in a self-contained manner. It is a further object of the invention to provide a hand holdable, automatically actuated pipette capable of highly accurate performance with good repeatability for each individual pipette as well as from operator to operator.

With a hand holdable, automatic pipette in accordance with the invention, high precision dilutions of solutions can be carried out. As described with reference to one form of a pipette in accordance with the invention, the intake stroke is divided into a first volume intake and a second volume intake stroke. The piston is advanced in a precise manner from a first intake start position to a second or multiple intake start position where piston motion is stopped. During this first piston movement a sample from a first fluid is taken up. A second sample from a second fluid is taken up by continuing piston motion to a stop. At this position the pipette carries a total sample formed of different fluids in proportion to a desired dilution. When the piston is thereupon actuated along a discharge stroke, the liquid samples are ejected.

The second or multiple intake start position may be fixed or moved to provide various dilution ratios. Similarly, the full stop can be fixed or moved to provide a selection of the total volume.

It is, therefore, a further object of the invention to provide a hand holdable, automatically operated pipette with which precise dilutions of fluid can be achieved with very small samples in an accurate manner.

It is well known in the use of pipettes to employ replaceable tips. These tips are of a disposable type and serve to avoid contamination such as when handling corrosive liquids, toxic reagents or biological solutions and the like.

Typically, such replaceable tips have a conically shaped opening in communication with a through bore terminating at a working end. The conically shaped end of the tip frictionally engages a corresponding external surface at the working end of the pipette. If some air leakage occurs between the replaceable tip and the pipette end, a source of error is introduced in the quantity of the liquid sample taken up. Such error is particularly significant when small sample volumes are being handled. In order to provide as best a fit as possible, the conventional pipette tip is commonly forced onto the pipette end by manually applying a twisting motion to the tip as it is forced onto the pipette. This entails a manual engagement of the tip with an undesirable increased chance of contamination by or of the material being handled.

With a replaceable tip in accordance with the invention, and as further described in a copending application filed on the same day as for this invention and entitled "Replaceable Tip for a Pipette" by the same inventor as of this invention and assigned to the same assignee, further improvement in the accuracy and repeatability of the pipette is obtained by automatically reducing air leakage between the tip and the pipette end while dispensing with the need for manual tightening of the tip onto the pipette end.

In accordance with the invention described in the copending application, the pipette engaging end of a replaceable tip is provided with a cam surface shaped to engage a wedging element on the pipette end. As an operator inserts a pipette end into a tip, the latter is frictionally pressed onto the pipette end with a slight rotational action which is automatically induced by the action of the pipette end's wedging element on the cam surface of the tip. As a result, a tightly fitting tip is obtained without manually touching of the tip.

Release of the tip can be obtained by either advancing the wedging element towards the tip but preferably by rotating the wedging element. This causes slight tip rotation to result in its clean separation from the pipette in a gentle manner effectively without potential splashing.

As further described with reference to one pipette embodiment in accordance with the invention, a seal element is employed between the pipette end and the replaceable tip. The seal element serves to reduce air leakage for improved accuracy of the pipette.

The seal element can be molded as part of the replaceable tip or provided as a separate resilient element around the pipette end. Particularly high quality sealing is obtained when the seal is formed between a resilient element on the pipette end and a conventional molded ring on the inner surface of the replaceable tip.

The resilient element around the working end of the pipette may be formed in several ways, such as with a conically shaped elastomer insert bonded to the pipette or one or more O rings set in grooves.

It is, therefore, a further object of the invention to provide a highly effective seal between a replaceable pipette tip and a pipette without requiring manual handling of the tip. It is still further an object of the invention to provide a working end of a pipette capable of establishing a quality, low leakage engagement with a replaceable pipette tip. It is a further object of the invention to provide improved discharge of liquid samples from a pipette.

The physical constraints imposed on a pipette in accordance with the invention limit its size to one which can be comfortably manipulated and held in the hand of most operators. The main housing of the pipette can neither, therefore, be too large, nor should the pipette weigh more than an amount which would cause early operator fatigue. Furthermore, in order for the pipette to be particularly effective, it is desirable that it be fully portable and self-contained and easily manipulated. Preferably, therefore, a pipette in accordance with the invention operates on an internally retained power source and techniques are employed to preserve the stored power source.

For example, in accordance with one technique employed in a pipette in accordance with the invention, a low current demanding control is used to control operation of the pipette. The control provides control signals which limit power drain when the pipette piston is not moved. Simple operator actuation sequences the control through the entire pipette cycle commencing with an intake cycle which terminates with a "sample filled" position of the piston. This latter state may continue for some time while the operator carries the taken-up liquid sample to the desired discharge place. Then, the operator again actuates the pipette to cause a discharge cycle during which the liquid sample is ejected.

Fail safe features are employed to prevent operator error. For example, in one technique wherein an actuator is employed, an inhibit technique is used to prevent multiple actuations while the pipette is driven through its cycles. In one form in accordance with the invention, the inhibit element is an integral part of a mechanical initiator which is provided with a directional sensitivity whereby the initiator's effectiveness is limited to a single use for each cycle of operation. In another inhibit technique, the control generates control signals needed to actuate the pipette, but are disabled once the piston is being moved to thereby avoid undesirable multiple actuations.

It is, therefore, a further object of the invention to provide a hand holdable, automatically actuated pipette which is self-contained, light weight, convenient to manipulate, reliable and safe in its operation.

These and other advantages and objects of the invention can be understood from the following description of several embodiments which are described in conjunction with the drawings.

BRIEF DESCRIPTION OF DRAWINGS

FIGS. 5 through 8 are schematic representations showing a sequence of operative positions of a mechanical initiator for use with a pipette in accordance with the invention, wherein FIG. 5 illustrates the mechanical initiator in preactuated position;

FIG. 6 illustrates an actuated position of the mechanical initiator at the start of the pipette cycle;

FIG. 7 illustrates a premature actuation of the mechanical initiator during a discharge cycle of the pipette;

FIG. 8 illustrates the directional sensitivity of the mechanical initiator to protect the pipette against operator error;

DETAILED DESCRIPTION OF EMBODIMENT

Figure 1:
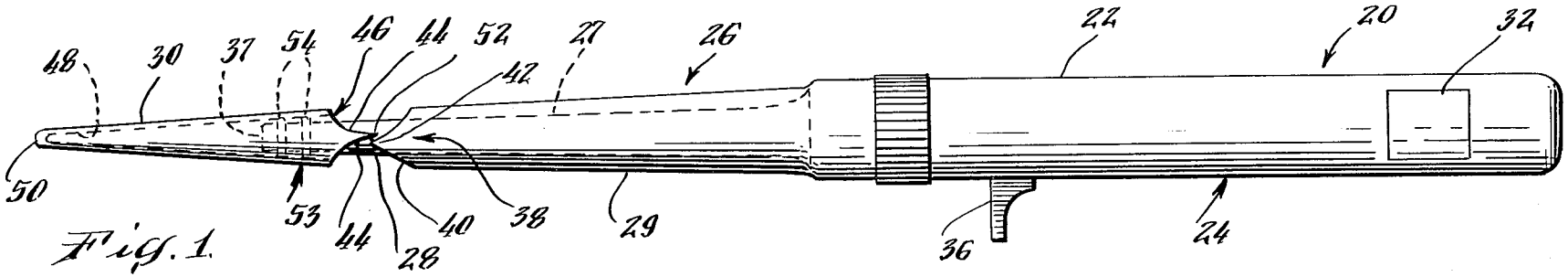
FIG. 1 is a plan view in elevation of a hand holdable, automatically actuated pipette with an assembled replaceable pipette tip in accordance with the invention.
Figure 3:
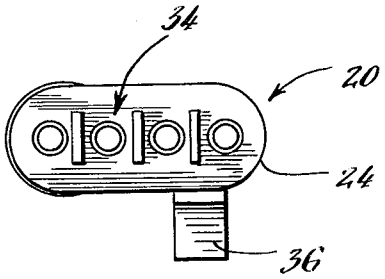
FIG. 3 is an end view of the pipette shown in FIG. 1.
Figure 2A:
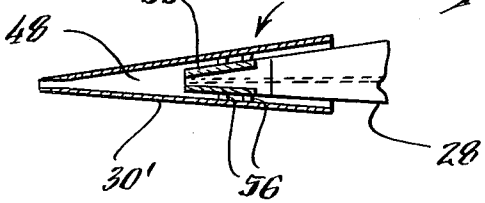
FIG. 2A is a partial sectional and side view of an alternate form for the working end of a pipette to which a replaceable tip is assembled in accordance with the invention.
Figure 2:
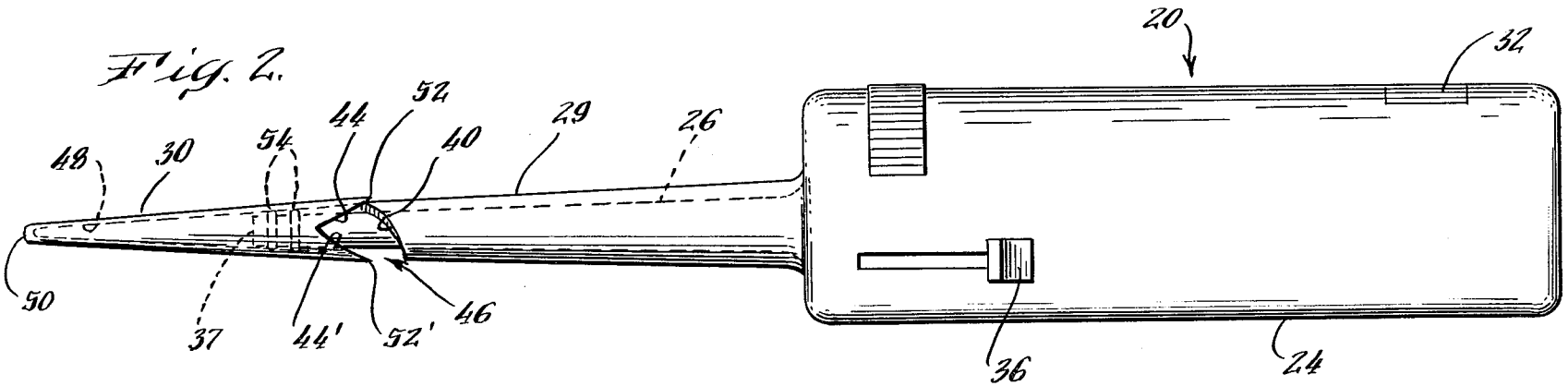
FIG. 2 is a side view in elevation of the pipette and pipette tip shown in FIG. 1.

With reference to FIGS. 1, 2 and 3, an automatic, hand holdable pipette 20, not to scale, in accordance with the invention is illustrated. The pipette 20 is formed of a main housing 22 which has a size selected to fit in and be conveniently held by an operator in one hand. The pipette housing 22 is formed of an upper located manually holdable segment 24 and a lower segment 26. The lower segment 26 includes a cylinder barrel 27 rotatably mounted in an extension 29 rigidly attached to upper segment 24. The cylinder barrel 27 protrudes from an extension 29 with an externally tapered working end 28 sized to snugly fit within a replaceable pipette tip 30. The upper segment 24 includes a motor, actuators and circuit elements to provide various operational functions as will be more fully described.

The pipette 20 is provided with a push button actuator 32 and a suitable display 34 to indicate the state of operation of the pipette. A side located ejector 36 is employed to release a disposable tip 30 when it has served its function.

The extension 29 of pipette 20 is provided with a replaceable tip tightening and releasing element 38 which terminates short of the pipette end 37 on cylinder barrel 27 with a generally V-shaped wedging surface 40 having an apex 42 facing pipette end 37. The wedging surface 40 is selected to cooperate with a cam surface 44 on replaceable tip 30 to induce a slight rotational action thereof for tightening of the tip onto the exposed working end 28 of cylinder barrel 27.

The disposable tip 30 preferably is formed of an injection molded plastic material and has one or more cam surfaces 44 at a pipette receiving end 46. The replaceable pipette tip 30 has a through bore 48 extending to a tip end 50 and is sized to take up a liquid sample and retain it for transport to a desired place. The through bore 48 is conically shaped at the pipette receiving end 46 with generally the same cone angle as the external surface of the tapered working end 28 of cylinder barrel 27.

The cam surface 44 has an apex 52 which, upon insertion of the pipette end 28 into bore 48 of a replaceable tip 30, contacts a wedging surface 40 of extension 29. This causes a slight rotation of the tip 30 resulting in an automatic tightening between the tip 30 and pipette 20 and enhanced sealing therebetween without manual touching of tip 30.

Removal of tip 30 is obtained by providing relative rotational motion between tip 30 and wedging surface 40 on extension 29. Such rotational motion may be obtained with ejection lever 36 which is coupled to rotate the cylinder barrel 27 of pipette 20.

As can be seen from the view of FIG. 2, tip 30 is provided with a pair of cam surfaces 44-44' and apices 52-52'. The cam surfaces 44 recede from the apices 52 along a spiral line whose pitch is selected to assure the desired twisting-tightening motion during attachment to pipette 20. The tapered working end 28 of the pipette 20 is shown provided with a resilient seal 53 in the form of a pair of O rings 54 set in corresponding grooves. The seal element further enhances the air seal between the tip 30 and pipette 20.

FIG. 2A illustrates a modified form of a seal 53' whereby the working end 28 of the pipette is provided with a frusto conical resilient insert 55 such as can be made of a suitable elastomer material. Insert 55 may be bonded to the working end 28 and may include molded O rings for enhanced sealing with a tip 30. Seal 53' is particularly effective when a tip 30 is provided with a pair of conventional annular molded O rings 56 which inwardly project into bore 48 of tip 30' near its pipette receiving end to engage a resilient insert 55.

Figure 4:
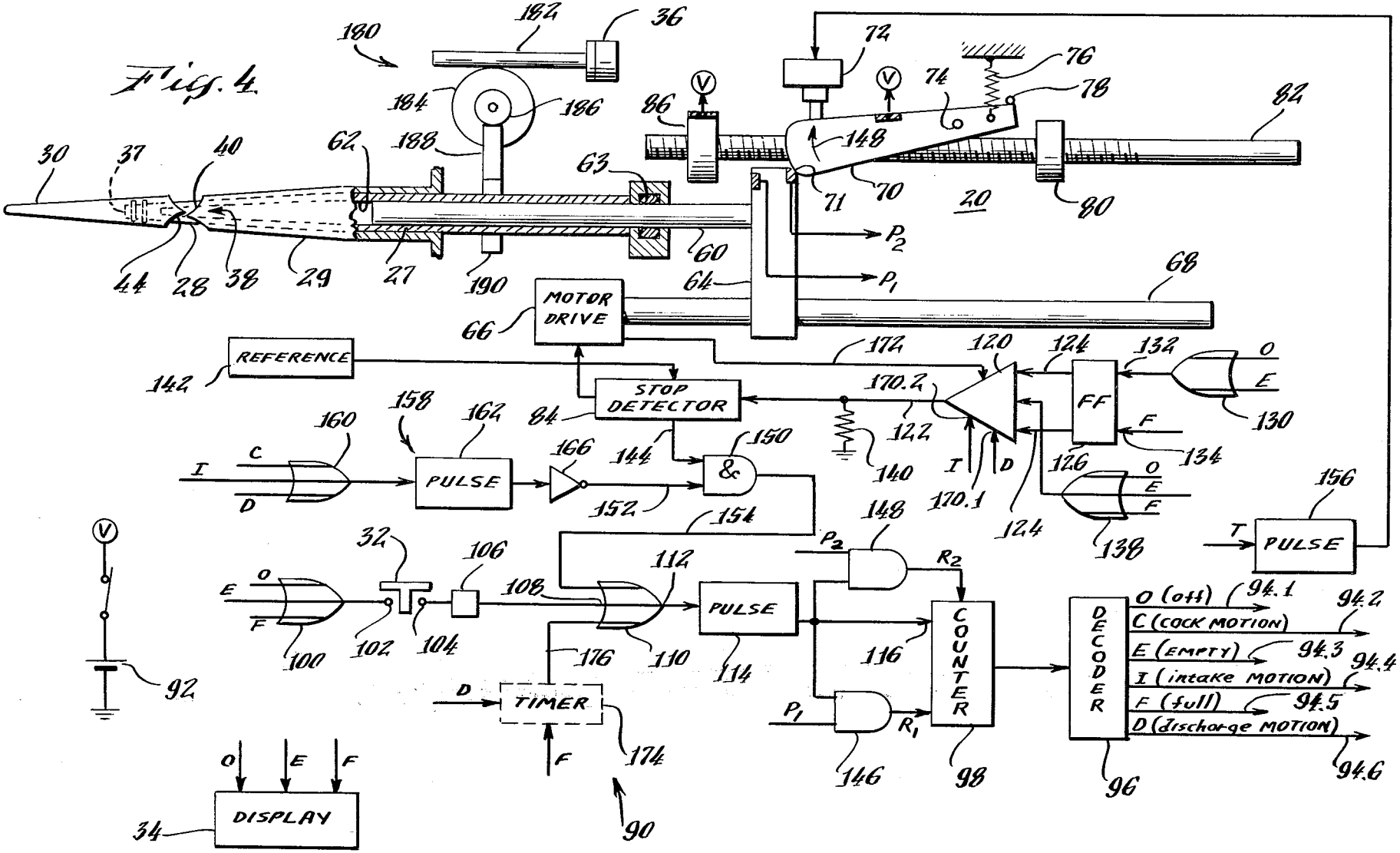
FIG. 4 is a schematic representation of mechanical and electrical features used in one form for a self-contained, hand holdable, automatically actuated pipette in accordance with the invention.

As previously explained, operation of pipette 20 is automatic once it has been actuated by the operator. The pipette 20 includes within its main housing 22, as illustrated in FIG. 4, a rotationally mounted elongated cylinder barrel 27 in which a piston 60 is operatively mounted. The cylinder 27 has a bore 62 shown with exaggerated size for clarity since for handling very small quantities of liquid the bore 62 may have a small cross-section and may be varied to handle various ranges of liquid samples.

The piston 60 is shown in the form of a plunger rod extending into the bore 62 through a seal 63 and is provided at one end with an engaging element 64 for reciprocational control of piston 60 along the axis of cylinder bore 62. Reciprocation of piston 60 provides intake or discharge conditions at the liquid flow control port 37 located at the tip of working end 28.

Reciprocation drive of piston 60 is provided by an electric motor drive 66 including any needed reduction gears coupled to rotate a lead screw 68, which in turn is operatively connected to engaging element 64 of piston 60. Other drives may be used such as a belt coupled to the motor and piston 60. Hence, depending upon the direction of rotation of lead screw 68, the piston is moved either along an intake or discharge stroke.

In the view of FIG. 4, piston 60 is shown seated against a pivotally mounted gate element 70, which can be flipped or pivoted out of the intake path of the piston 60 by an actuator 72. The gate element 70 is pivoted about a pivot pin 74 and biased by a spring 76 against a stop pin 78 to a precisely defined position relative to piston 60. The gate element in FIG. 4 is shown pivotally mounted to housing 24; however, the gate element may also be mounted on piston 60 as explained with reference to FIGS. 5-8.

The start of the intake stroke of piston 60 begins with the piston 60 stopped against gate element 70 as shown in FIG. 4. The point of engagement 71 is precisely determined so that the piston commences its intake stroke at the same precisely known place.

When pipette 20 is operated, gate element 70 is pivoted out of the path of piston 60, which is advanced towards a full position under control by motor 66. The end of the intake stroke is determined by a "sample full" stop 80 positioned in the path of piston 60 along a threaded bar 82. Stop 80 may be moved along bar 82 to form a pipette having a different intake stroke and thus capable of handling different volumes.

A detector 84 is employed to sense when piston 66 is driven at the end of the intake stroke against stop 80 and causes termination of further motor drive until a discharge of the liquid sample is to be made.

Upon commencement of a discharge stroke, piston 66 is driven back into the cylinder bore 62 by reversing the drive from motor 66. The discharge stroke of piston 66 is accommodated by gate element 70 which pivots out of the way as piston 66 moves toward a discharge stop 86. Detector 84 senses when piston 60 engages discharge stop 86, and causes a cessation of further discharge drive motion. With the piston located against stop 86, a repeat of an intake stroke is commenced with an initial drive of piston 60 against gate element 70 to establish a precisely defined intake starting position. The extension of the discharge path past the intake start position at 71 provides additional air for a "blow-out" of remaining sample residue.

As will be further described with reference to the embodiment shown in FIG. 11, the intake stroke may also commence at the discharge stop 86. In such case the pipette can be advantageously used to carry out a highly accurate dilution operation.

As can be appreciated from the schematic representation of FIG. 4, the length of the intake stroke of piston 60 is precisely determined by the spacing between gate element 70 and intake stop 80. The intake stroke can be varied by moving stop 80 or by employing a stepping motor in precise increments in a manner as described in the aforementioned Nishi patent. The intake stroke speed is controlled by motor drive 66 whose rotation is geared down with reduction gears within the space of upper housing segment 24.

A control circuit 90 is provided inside main housing 24 of pipette 20 to provide the previously described pipette functions. Control circuit 90 employs electronic logic circuits selected for low current drain from a preferably rechargeable battery 92 which provides a driving voltage V.

Control circuit 90 generates control signals on lines 94.1–94.6 from a decode network 96 connected to counter 98 having six discrete counts. The control signals on lines 94 respectively represent operational sequences for the pipette 20. Thus, commencing with the piston 60 against discharge stop 86, an O, for OFF, position control signal is produced on line 94.1.

When the operator actuates push button 32, a C, for a cock motion control signal occurs on line 94.2 and persists until piston 60 encounters gate element 70. At that time an E, for empty, position control signal occurs on line 94.3 and persists until the operator initiates an intake stroke by again actuating push button 32.

While piston 60 is moved along its intake stroke, an I, for intake, motion control signal is produced on line 94.4 and persists until piston 60 engages the "sample-full" stop 80 at the end of the intake stroke. At that time an F, for sample full, position control signal is generated on line 94.5 and lasts until the operator again actuates push button 32 to commence a discharge stroke. A D, for discharge, motion control signal is produced on line 94.6 while the piston is on its discharge stroke.

When piston 60 again engages the discharge stop 86, the O, for off, position control signal is again produced and the pipette cycle can be repeated. The control 90 cycles the pipette 20 through these operations in a fully automatic, consistent manner, subject only to a simple operator actuation of push button 32.

When pipette 20 is initially actuated, i.e. with piston 60 against the discharge stop 86, the off, O, control signal is active and applied through an OR gate 100 to terminal 102 of normally open push button switch 32. Terminal 104 is connected through a debounce network 106, used to avoid multiple pulses from a single actuation, to input 108 of an OR gate 110.

The output 112 of OR gate 110 in turn is applied to pulse network 114 which delivers a pulse to input 116 of counter 98. The latter is advanced by a count of one by each pulse on input 114.

When the counter 98 is advanced, the decode network 96 generates the C motion control signal to drive the piston from discharge stop 86 to the gate element 70. The electrical power for motor drive 66 is delivered by an amplifier 120 whose output 122 has a polarity determined by input signals on lines 124 as controlled by a motor directional control flip-flop 126.

From movement of piston 60 from discharge stop 86 to the sample-full stop 80, the O, for off, and E, for empty, control signals are applied through OR gate 130 to input 132 of flip-flop 126.

For a discharge motion, the polarity of flip-flop 126 is reversed by applying the F, for sample-full, position control signal to input 134.

Power from amplifier 120 is applied through stop detector 84 to motor drive 66. Since amplifier 120 may draw an undesirable amount of power, amplifier 120 is formed with a logic network to effectively remove the current demanding components. A control circuit, such as an OR gate 136 is provided to enable deactivation of amplifier 120 and enable its output 122 to have an effectively "zero" drive signal. The voltage level of such zero drive signal may vary, and is for purposes of illustration suggested as equal to ground by virtue of the return to ground of line 122 by resistor 140.

Deactivation of amplifier 120 occurs in response to the position control signals, O, E and F applied to the input of OR gate 138. Hence, current drain can be kept quite small when pipette 20 is either not in use, or between cycles, or while a stored sample is being transported to a discharge site.

Detection of the engagement by piston 60 of stops 86, 70, and 80 is done with a current detector 84 coupled in series between amplifier 120 and motor drive 66. Detector 84 senses a significant increase in the stall current drawn by the motor 66 when it is driven against a stop. The stall current is sensed by comparing the sensed current with a reference value established by a suitable source 142 and producing a stop signal on line 144 when the sensed current exceeds the reference value. The stop signal is then employed to sequence counter 98 to its next digital count in the operation of pipette 20.

Other sensing elements can be employed to detect the arrival of the piston against a stop. For example, an optical element or a contact switch may be used. With a contact switch, isolated contacts 146.1 and 146.2 are mounted on piston 60 while stops 70 and 86 are provided with contacts connected to voltage source V. Hence, contact by piston 60 with stop 86 produces a $P_1$ stop signal and contact with stop 70 generates a $P_2$ stop signal. These stop signals are applied to AND gates 146, 148 respectively to provide synchronizing reset signals $R_1$ and $R_2$ to counter 98.

Reset signal $R_1$ causes a reset of counter 98 to a count corresponding to that necessary to produce the O position control signal on line 94.1. The reset signal $R_2$ causes an overriding reset in counter 98 to a count corresponding to the E position control signal on line 94.3. In this manner synchronization between the operation of counter 98 and the motion of piston 60 is automatically maintained.

When piston 60 contacts gate element 70 at 71, a stall current is detected by detector 84 and an enabling signal applied on line 144 to an AND gate 150. Since piston 60 is stopped, input line 152 to AND gate 150 is also enabled and an output pulse arises on line 154 to actuate pulser 114 through OR gate 110. This causes an advance in the counter 98 and a subsequent removal of drive from amplifier 120 by virtue of the generation of the E, for empty, position control signal.

The operator may now commence an intake stroke by again actuating push button 32. This allows the E position control signal to cause an advance of counter 98 which then produces the I motion control signal from decoder 96. The I motion control signal is applied to a pulse network 156 to deliver a gate releasing signal on line 158 to actuator 72 so that gate element 70 is pivoted out of the way and the piston permitted to advance along an intake stroke to take in a liquid sample through tip 30.

Since the initial current to start motor 66 may be large, an inhibiting network 158 is employed to prevent stop detector 84 from being erroneously activated. Network 159 operates by applying the I, or intake motion control, signal through an OR gate 160 to a pulse network 162 to produce an inhibiting pulse on line 152 from an inverter 166. The pulse on line 152 momentarily disables AND gate 150 to prevent inadvertent generation of a sequence advance pulse to counter 98 by stop detector 84 during start-up of the intake stroke. Similar inhibiting action is obtained when other piston motions, such as a discharge stroke and cocking motion are commenced by applying the D and C motion control signals to OR gate 160.

While piston 60 is moved along an intake stroke, it is desirable to lock out operator control over the operation. This is automatically achieved by enabling push button 32 only by control signals which are in synchronization with the stationary positions of piston 60. Hence, each of the position control signals O, E and F are applied to the input of OR gate 100. As a result, operator interference by actuation of push button 32 during both the intake and discharge strokes is rendered ineffective. On the other hand, operator control during the off, empty and full positions is permitted.

When piston 60 reaches intake stop 80, motor 66 is stalled and an increase in drive current along line 122 occurs. The increased drive current is compared with the reference value by stop detector 84 which senses the stalled condition and produces a stop signal on line 144 indicative thereof. The stop signal is coupled through AND gate 150 and OR gate 110 to pulse network 114 which advances counter 98 to its full or F state.

An F, for full, position control signal on line 94.5 represents that a liquid sample is held by a pipette 20. The F signal is applied as a level to motor directional control flip-flop 126 to establish a discharge polarity which is a reverse of the previous polarity. While position control signal F is active, the drive to motor 66 is interrupted and a zero drive signal is established on line 122.

When the operator has carried the liquid sample to a desired discharge spot, another actuation of push button control switch 32 is made. This removes the disabling input to amplifier 120 and enables motor 66 to drive piston 60 along a discharge stroke at a speed determined by the effect of the D motion control signal on a gain setting input 170 to amplifier 120.

A particular advantage of the hand holdable, automatically operated pipette resides in a consistent speed for piston 60, both for intake and discharge strokes. When a motor drive 66 is employed, a constant speed of piston 60 is achieved by sensing motor performance and applying a feedback signal on line 172 to amplifier 120 to achieve the desired constant speed. One technique for sensing motor performance is by detecting the back emf generated by the motor. Another technique may detect the rotational speed of lead screw 68.

A further advantage of the automatic pipette operation involves the control one may exercise over both intake and discharge stroke speeds. These speeds can be selected by use of gain control inputs 170.1 and 170.2 to amplifier 120. The intake stroke speed can, for example, be selected low by limiting the effect of the I motion control signal through input 170.2 with a suitable voltage divider (not shown). Similarly, the discharge stroke speed can be selected. Stroke speed control can be set in the factory or be user controlled with potentiometers in the voltage dividers and made accessible to an operator.

Piston 60 is driven to discharge stop 86 at a speed deemed desirable to eject the previously taken up sample. The speed of the discharge stroke can be increased to assure complete sample ejection followed by a suitable air blow-out since the discharge stroke is longer than the intake stroke. One technique for such speed increase may involve applying the discharge motion control signal D to gain control input 170 of amplifier 120.

When piston 60 engages stop 86, stop detector 84 produces a sequence advance pulse to counter 98, which sets a count corresponding to a cycle complete or off state. The off, O, position control signal is then decoded on line 94.1 and the pipette is ready for a repeat actuation.

The position control signals O, E and F permit a convenient read-out of the status of the pipette. For an operator it is particularly advantageous to be able to know whether the pipette is in the off, O, empty, E, or full, F, position. Hence, the position control signals O, E and F are shown in FIG. 4 coupled to a low current drawing display 34 to provide the appropriate indication. A liquid crystal display may be used.

The use of control 90 enables particular safety features. For example, excessively long storage periods of a liquid sample can be prevented. A timer network 174 may be used whose output on line 176, is connected to OR gate 110. Network 174 is enabled by the full position control signal F and will deliver a pulse on line 176 after a certain time period unless disabled by position control signal D within that time.

For example, if the operator fails to activate a discharge cycle within, say, 60 seconds after a sample is taken up, the protective network 174 will cause such a discharge cycle by delivering a sequence advancing signal on line 176. The time period can be varied or may be fixed such that it will accommodate most pipette operations. The timer 174 is optional and, therefore, is shown in phantom in FIG. 4.

As previously described, the replaceable tip 30 can be discharged or released from pipette 20 by rotating the cylinder barrel 26 to which the tip 30 is mounted. Such rotation may be obtained with release lever 36 a rotation mechanism 180 of various forms. In the embodiment of FIG. 4 a rack 182 is connected to lever 36 and spring loaded to retain the indicated position of lever 36. The rack 182 is coupled to a pinion 184. Pinion 184 is connected to a worm 186 which, in turn, drives a gear 188 in operative contact with a gear 190 affixed to cylinder barrel 26. Hence, linear movement of lever 36 along the axis of cylinder barrel 26 is converted to rotational movement of the latter. This drives the cam surface 44 of tip 30 against the wedging surface 40 of extension 29. The result is a release and gentle axial ejection of tip 30.

FIGS. 5–8 illustrate a partial alternate embodiment for a pipette wherein a gate element 70' is mounted on the piston 60. The gate element 70' is shown pivotally mounted on a pivot pin 74' and normally biased by a spring 76' against a stop 78' also located to move with piston 60. The pipette has a fixed intake stop 230 which is so located as to operatively engage the end 232 of gate element 70' when it is returning in the direction indicated by arrow 234 from a discharge stroke.

A pipette operation initiator 236 is shown operatively mounted to move in the direction indicated by double-headed arrow 238 towards and away from gate element 70'. The operation initiator is shown in the form of a push button 240 mounted for movement in the direction of arrow 238 and having a spring 242 which is cantilever mounted. Spring 242 is compressible when it engages the gate element 70' during initiating movement, but deflects aside when a lateral force from a sidewardly moving and engaging gate element 70' occurs.

In FIG. 5 the initiator 236 and gate element 70′ are illustrated in their normal position prior to a take-up stroke. Thus, gate element 70′ is seated against intake stop 230 and initiator 236 is at its normal return position.

In FIG. 6 initiator 236 is shown actuated in the direction indicated by arrow 238′ and spring 242 is urged against gate element 70′. The force from initiator 236 is sufficient to clear end 232 of gate element 70′ from stop 230 and permit commencement of an intake stroke. Hence, with initiator 236, the power demand solenoid 72 of FIG. 4 is dispensed with. Suitable switches to activate control circuits such as described with reference to FIG. 4 are provided along the path of push button 240.

With a mechanical initiator the possibility arises that an operator will maintain or return the push button to the actuating position of FIG. 6 before the piston 60 has returned to its take-up position. Such possibility is illustrated with FIGS. 7 and 8.

The initiator 236, however, is formed with a cantilever mounted resilient element 240 which yields, as shown in FIG. 8, to the moving gate element 70′ and permits it to seat against stop 230. As a result, harmful operation of the pipette is prevented, while a power demanding solenoid 72 can be dispensed with.

Figure 9:
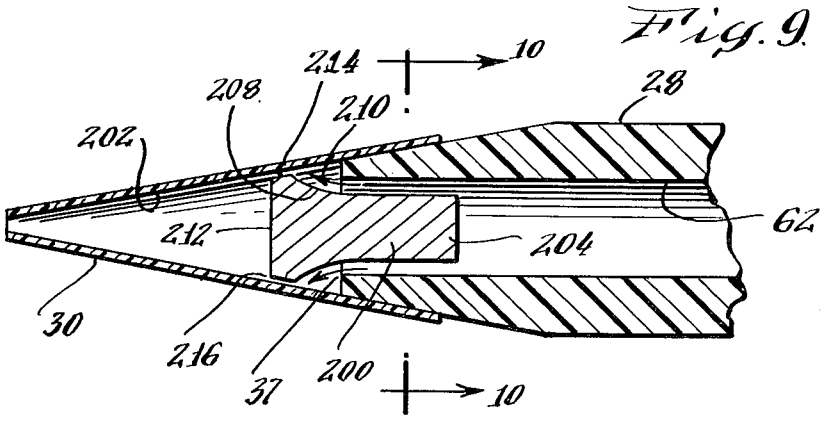
FIG. 9 is an enlarged sectional view of a modified form of the working end of a pipette.
Figure 10:
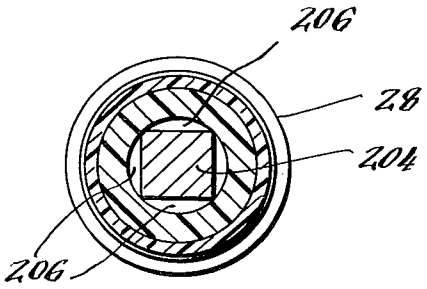
FIG. 10 is a section view of the working end of the pipette taken along the plane defined by the lines 10—10 in FIG. 9.

With reference to FIGS. 9 and 10, a modification of the working end 28 of a pipette 20 is shown whereby enhanced total ejection of a liquid sample can be achieved. The liquid flow control port 37 of pipette end 28 is provided with an air deflector 200 shaped to deflect air flow during discharge towards the inner wall 202 of replaceable tip 30. The air deflector 200 is formed with an angularly shaped segment 204 which fits into bore 62 with slight interference to form a tight fit.

In the embodiment shown in FIGS. 9 and 10, the segment 204 is square shaped while bore 62 is round. As a result, wall located air flow passages 206 are formed between segment 204 and the wall of bore 62. Air deflector 200 has an enlarged intermediate segment 208 protruding past the end 37 of pipette 20. The segment 208 deflects discharge air flow from passages 206 towards inner wall 202 as suggested by arrows 210.

The intermediate deflecting segment 208 preferably has a conical shape expanding in cross-section from segment 204 towards wall 202 of replaceable tip 30. Segment 208 merges with a conical front section 212 whose radially outer periphery 214 is sized to form an annular passage 216 with replaceable tip wall 202.

With an air deflector 200 applied to the working end of a pipette, air flow during discharge tends to flow along the tip wall 208. In this manner enhanced discharge of a previously taken up liquid sample can be achieved to enhance the accuracy of the pipette.

The pipette 20 of FIGS. 1–4 is also suitable for a dilution function. In such use, the cocking motion of the piston 60 from the discharge stop 86 to gate element 70 is employed as a first intake stroke to take in a first liquid sample. A second intake stroke is obtained with the intake motion of piston 60 from gate element 70 to the sample full stop 80. The ratio of the respective first and second intake strokes determines the dilution ratio.

Figure 11:
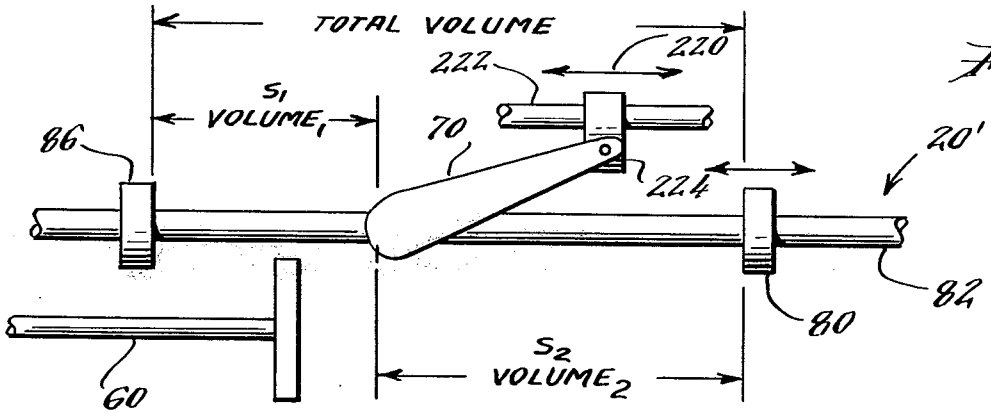
FIG. 11 is a schematic representation of a dilution pipette in accordance with the invention.

The pipette embodiment 20′ illustrated in FIG. 11 is particularly suited to provide various dilution ratios as well as total sample volume selections. A gate element 70 is employed, but it is mounted for movement to the pipette housing along the directions indicated by double headed arrow 220. Adjustment of the position of gate element 70 is made with the rotation of a lead screw 222 operatively coupled to a mounting 224 for gate element 70. Such adjustment of gate element 70 varies the intake strokes $S_1$ and $S_2$, to correspondingly vary the dilution ratio. The total volume preferably is selectable in discrete sizes to facilitate manual selection of dilution ratios.

Having thus described a manually holdable, automatically operated pipette in accordance with the invention, its advantages can be appreciated. The pipette provides enhanced accuracy in its operation, yet is capable of a portable operation in a self-contained manner over an extended time period. Variations of the described embodiment can be made by one skilled in the art without departing from the full scope and spirit of the invention.

What is claimed is:

1. An automatically operable pipette for taking up and discharging liquid comprising:

a main housing having a liquid flow control port at one end to control the flow of liquid, said main housing being shaped to be conveniently held in a single hand;

displacement means mounted in the main housing and having a variable displacement volume in fluid communication with the liquid flow control port of the main housing to produce cycles of take-up and discharge of fluid through said port; said displacement means including a cylinder in fluid communication with the liquid flow control port and a piston operatively mounted for intake and discharge strokes in the cylinder to vary the volume therein for the control of the intake and discharge of liquid, said cylinder having an effective length selected to enable said piston to move a distance which is substantially greater than the normally effective range of a finger actuated motion of a piston for a pipette, said cylinder having a crossectional area which is selected sufficiently small to significantly enhance the accuracy of the pipette for relatively small displacement volumes;

motor means mounted in said main housing and operatively coupled to said piston to drive the piston through fluid intake and fluid discharge cycles; and control means mounted in said main housing to control operation of said motor means through the fluid intake and fluid discharge cycles of the displacement means and cause said piston to be moved between precisely defined intake positions, said control means including:

i. first stop means for precisely defining the initial position of the piston at the beginning of the intake stroke of the piston;

ii. second stop means for precisely defining the position of the piston at the end of the intake stroke; and iii. means for varying the operative location of said second stop means to correspondingly vary the stroke length of the piston to form a variable volume pipette.

2. The automatically operable pipette as claimed in claim 1 wherein said first stop means is formed of a pivotally mounted gate element having a stop surface located to effectively seat and stop the piston from movement along an intake stroke direction, said gate element further being capable of pivoting out of the way during piston movement along a discharge stroke direction.

3. The automatically operable pipette as claimed in claim 2 wherein said control means further includes
means for sensing arrival of the piston at said gate element and at said second stop means; and
means responsive to said sensing means to effectively interrupt power to said motor means.

4. The automatically operable pipette as claimed in claim 3 wherein said sensing means further includes
means for sensing electrical current flow to said motor means; and
means for comparing said sensed current flow to a reference value to produce a stop signal indicative of the engagement of said piston with one of said stop means.

5. The automatically operable pipette as claimed in claim 2 wherein said gate element is effectively pivotally mounted on the piston.

6. The automatically operable pipette as claimed in claim 2 wherein said gate element is effectively pivotally mounted to the main housing.

7. The automatically operable pipette as claimed in claim 2 wherein said control means further includes
means for actuating said gate element to pivot it out of its piston stopping position to enable a take-up stroke thereof.

8. The automatically operable pipette as claimed in claim 7 wherein said means for actuating the gate element is formed of a spring which is compressible along an axis and is mounted adjacent the gate element to effectively pivot the gate element upon operative movement of the spring along its compressible axis to a gate release position, said spring being laterally deflectable to effectively disable the operation of said spring when its gate release position is inadvertently retained.

9. In a pipette for taking up and discharging liquid, the improvement comprising
a main housing having a liquid flow control port at one end to control the flow of liquid, said main housing being shaped to be conveniently held in a single hand;
said main housing having a working end which is externally shaped at said liquid flow control port to fit inside a disposable pipette tip;
said main housing further being provided with a wedging element near the liquid flow control port to face a disposable tip; said wedging element being so shaped to impart a twisting movement on a replaceable pipette tip when it is applied to the main housing to enhance engagement of the disposable tip with the working end of the main housing.

10. The improvement of claim 9 wherein said main housing is further provided with
means for causing relative rotation between a disposable tip and said wedging element to release said tip from the main housing.

11. The improvement of claim 10 wherein said main housing is further provided with a lower segment extending towards said liquid flow control port and terminating with said wedging surface;
a rotatably mounted cylinder barrel mounted within said main housing and protruding from said lower segment with said working end for a distance sufficient to fit inside a replaceable tip and frictionally engage same; and
means for rotating said cylinder barrel to drive a replaceable tip against the wedging element for release of the disposable tip.

12. The improvement of claim 9 wherein said discharge end of the main housing is provided with an externally facing resilient element selected to provide enhanced sealing engagement with a replaceable tip.

13. The improvement of claim 12 wherein said resilient element is frusto conically shaped.

14. The improvement of claim 12 wherein said resilient element is formed of a pair of O rings sized to frictionally and sealingly engage the internal surface of a replaceable tip.

15. The improvement of claim 9 wherein the wedging element is shaped with an apex located to contact and rotate a replaceable tip when it is applied to the main housing.

16. The improvement of claim 15 wherein the wedging element further is provided with a wedging surface extending from the apex in a direction selected to rotate said tip when a tip engages the wedging surface.

17. A pipette control for a manually holdable pipette to control the precise intake and discharge of small quantities of liquid with a pipette having a liquid flow control port, a cylinder in communication with the liquid flow control port and a motor driven piston mounted in the cylinder for reciprocal movement between an intake starting position, a sample full stop and a discharge stop for control of intake and discharge of a sample of liquid comprising
gate means to stop the piston in a predetermined position prior to an intake stroke;
means for producing stop signals when said piston engages said gate means, said sample full stop and said discharge stop;
means responsive to one of said stop signals for producing a control signal representative of an intake stroke;
means responsive to the intake control signal for releasing the gate means and enable said piston to advance to said sample full stop; and
means responsive to stop signals representative of engagement by the piston with said gate means and the sample full stop for terminating drive to said piston.

18. The pipette control as claimed in claim 17 wherein said control signal producing means further includes
means for establishing a drive signal to said motor driven piston for its movement at a substantially consistent speed.

19. The pipette control as claimed in claim 17 and further including
means for producing a discharge control signal representative of the discharge stroke of the piston; and
means responsive to the discharge control signal for selecting the speed of the discharge stroke of the piston.

20. The pipette control as claimed in claim 18 and further including means responsive to the intake control signal for selecting the speed of the intake stroke of the piston.

21. The pipette control as claimed in claim 17 wherein said stop signal producing means includes
means for sensing motor stall currents in excess of a predetermined level and produce said stop signals as representative when said piston is stopped by said gating means of said sample full stop.

22. A pipette control device for controlling the precise intake and discharge of small quantities of liquid with a pipette having a liquid flow control port, a cylinder in communication with the liquid flow control port and a piston mounted in the cylinder for movement along a displacement axis to displace cylinder volume for control of intake and discharge of liquid, comprising means for automatically driving said piston along said displacement axis;

intake gate means operatively disposed along said displacement axis for producing a movable gate establishing an accurately definable starting position for said piston, said intake gate means being mounted for movement between piston stop and piston release positions;

intake termination means operatively disposed along said displacement axis for establishing an accurately definable intake completion stop for said piston;

discharge stop means operatively disposed along said displacement axis for establishing a discharge completion position for said piston;

means for moving said gate means between its piston release and piston stop positions;

a manually controlled actuator;

means effectively responsive to an intake operation of the manual actuator for producing an intake control signal representative of the start of an intake stroke of the piston;

means effectively responsive to the intake control signal for actuating the gate moving means to move the gate means to its piston release position and cause said driving means to commence an intake stroke of the piston towards the intake termination means;

means for sensing arrival of the piston at the intake termination means to interrupt operation of said piston driving means;

means for producing a discharge control signal representative of the start of a discharge stroke of the piston;

means effectively responsive to a discharge operation of the manual actuator to cause a discharge stroke of the piston toward said discharge stop means; and means for sensing arrival of the piston at the discharge stop means to interrupt operation of said piston driving means.

23. An automatically operated pipette for handling small samples of liquid comprising a main housing having a liquid flow control port at one end to control the flow of liquid, said main housing being shaped to be conveniently held in a single hand, displacement means mounted in the main housing and having a variable displacement volume in fluid communication with the liquid flow control port of the main housing and a piston operatively located to vary the volume for the take-up and discharge of liquids through said port;

means for establishing a first intake stop, a second intake stop and a third sample-full stop for said piston;

motor means mounted in said housing and operatively coupled to said displacement means to drive said piston at consistent speeds along an intake stroke from said first intake stop to said second intake stop and said samplefull stop and back to said first intake stop for a discharge of liquid samples; and control means mounted in said housing to control operation of said motor means throughout the fluid intake and fluid discharge cycles of the displacement means.

24. The automatically operated pipette as claimed in claim 23 wherein said second intake stop is adjustable relative to said piston to provide a variable dilution ratio of liquid samples.

25. The automatically operated pipette as claimed in claim 24 and further including power means mounted in said housing to provide power to drive said motor and control means to form a self-contained, portable, manually holdable, automatically operated pipette.

26. In a pipette for taking up and discharging liquid samples with the use of a replaceable tip the improvement comprising a main housing having a liquid flow control port at one end to control the flow of liquid;

an air deflector affixed in said liquid flow control port, said air deflector being selectively shaped to laterally direct air flow generated during a discharge cycle of the pipette.

27. The improved pipette as claimed in claim 26 wherein the main housing has a cylindrical bore in communication with the liquid flow control port said air deflector having an angular segment projected into said bore to form air flow passages with the wall of the cylinder bore;

said air deflector further being formed with an intermediate segment sized to expand from said angular segment to laterally direct discharge air flow.

28. The improved pipette as claimed in claim 26 wherein said air deflector is further formed with a front section sized to form a peripheral air flow passage with a wall of a replaceable tip when it is mounted on the pipette, said peripheral air flow passage providing a flow of air along said wall for enhanced discharge of a liquid sample from the pipette.

* * * * *